US006059698A

United States Patent [19]

Mazor

[11] Patent Number: 6,059,698

[45] Date of Patent: May 9, 2000

[54] EXERCISE DEVICE FOR REMOVABLE MOUNTING ON A DOOR

[75] Inventor: Robert A. Mazor, Suffern, N.Y.

[73] Assignee: Rob Mazor, Suffern, N.Y.

[21] Appl. No.: 08/874,069

[22] Filed: Jun. 12, 1997

[51] Int. Cl.[7] ..... A63B 21/04

[52] U.S. Cl. ..... 482/79; 482/129; 482/904

[58] Field of Search ..... 482/44, 79, 121, 482/129, 130, 904, 908

[56] References Cited

U.S. PATENT DOCUMENTS

| | | | |
|---|---|---|---|
| D. 264,862 | 6/1982 | Kokoska . | |
| 588,017 | 8/1897 | Sandow | 482/129 |
| 679,784 | 8/1901 | Ryan | 482/129 |
| 680,556 | 8/1901 | Wieland | 482/129 |
| 689,418 | 12/1901 | Ryan | 482/129 |
| 691,295 | 1/1902 | Schneider | 482/129 |
| 704,840 | 7/1902 | Korth et al. | 482/129 |
| 726,095 | 4/1903 | Nightingale | 482/129 |
| 1,112,114 | 9/1914 | Caines | 482/129 |
| 2,938,695 | 5/1960 | Ciampa . | |
| 4,109,907 | 8/1978 | Zito . | |
| 4,575,789 | 3/1986 | Forster . | |
| 4,611,805 | 9/1986 | Franklin et al. . | |
| 4,830,365 | 5/1989 | March | 482/129 |
| 4,861,020 | 8/1989 | Soligny . | |
| 5,100,129 | 3/1992 | Porter et al. | 482/129 |
| 5,277,683 | 1/1994 | Wilkins . | |
| 5,468,205 | 11/1995 | McFall et al. . | |
| 5,498,223 | 3/1996 | Iams et al. | 482/94 |
| 5,556,369 | 9/1996 | Roberts . | |
| 5,601,518 | 2/1997 | Weintraub . | |
| 5,766,118 | 6/1998 | Conner | 482/129 |

FOREIGN PATENT DOCUMENTS

| | | | |
|---|---|---|---|
| 3003093 | 8/1981 | Germany | 482/129 |
| 22076 | 10/1898 | United Kingdom | 482/129 |
| 2227979 | 8/1990 | United Kingdom | 482/129 |
| 87/04633 | 8/1987 | WIPO | 482/129 |

*Primary Examiner*—Richard J. Apley
*Assistant Examiner*—Victor K. Hwang

[57] ABSTRACT

The exercise device includes a pair of U-shaped brackets that are mounted on the top and bottom edges of the door. Suspended between the brackets are a plurality of elastic cords of different elasticities. By selecting different cords, different tensions or resistances can be obtained for exercise routines. An ankle strap may be used to exercise the leg muscles. In some versions, spacers may be provided between the U-shaped brackets and the door to prevent rocking.

3 Claims, 4 Drawing Sheets

EXERCISE DEVICE FOR REMOVABLE MOUNTING ON A DOOR

FIELD OF THE INVENTION

This invention relates to portable exercise devices, which may be simply mounted on any door.

BACKGROUND OF THE INVENTION

Exercise equipment of various types have been common for many decades. Such devices are available for exercising any muscle group of the body. Many different shapes and configurations are available.

There are devices that purport to be portable, and some devices are constructed so as to be mounted on a door or door frame. None of these devices, however, is both simple in its construction and versatile in its use.

One particular portable door mounted exercise apparatus is disclosed by McFall (U.S. Pat. No. 5,468,205). It utilizes upper and lower bases, which are connected together and suspended from the door by means of mounting straps. A plurality of pulleys are provided in each base and elastic cords are mounted between aligned upper and lower pulleys. Attachment eyelets are at each end of the cord to simplify attachment of an exercise handle.

A first difficulty with the door mounted apparatus of McFall is that it is not simple and easy to install on a door. Another problem is that it does not disclose elastic cords of different elasticities. Further, because of the construction with pulleys, it is a complicated and bulky device. It also does not provide for a wide range of exercise activities, as the cords may be pulled in only a limited number of directions.

Zito (U.S. Pat. No. 4,109,907) provides a door mounted weight lifting apparatus. Pulleys are suspended from the top of the door and cords pass through the pulleys. On the end of the cord, a weight is suspended and a handle is connected on the other end of the cord. The only way to change the tension is to change the weight. Further, there is again only a limited range of motion that is possible with this device.

Franklin (U.S. Pat. No. 5,611,805) discloses another type of portable exercise device. It includes elastic cords with handles, but it provides only a limited range of motion for exercise. Further, the elastic cords are of the same elasticity, so the tension provided is the same. To change the tension, the spring and/or the exercise bar must be changed.

Wilkins (U.S. Pat. No. 5,277,683) discloses an exercise strap which may be moved from one location on a door to another. In any one location, however, it cannot provide a full range of exercises. Further, the cord is only of a predetermined elasticity and the strap or cord would need to be changed in order to effect a change in the tension.

Therefore, there is a need in the industry to provide a simple and easy to use device, which provides a wide range of exercise motions to many different muscle groups.

SUMMARY OF THE INVENTION

The invention comprises U-shaped brackets which can be mounted on the top and bottom edge of the door. Suspended between an aligned pair of upper and lower brackets are a plurality of elastic cords of different elasticities. By selecting one or more of the elastic cords, different tensions can be achieved. Further, because of the manner in which the cords are mounted, a fill range of exercises can be achieved. It permits exercises of multiple muscle groups at the same time. By positioning the body and adjusting the cords, the exercise system will permit isotonic, isometric, concentric, eccentric, plyometric and P.N.F. patterns of exercises.

DETAILED DESCRIPTION OF THE INVENTION

Figure 1:
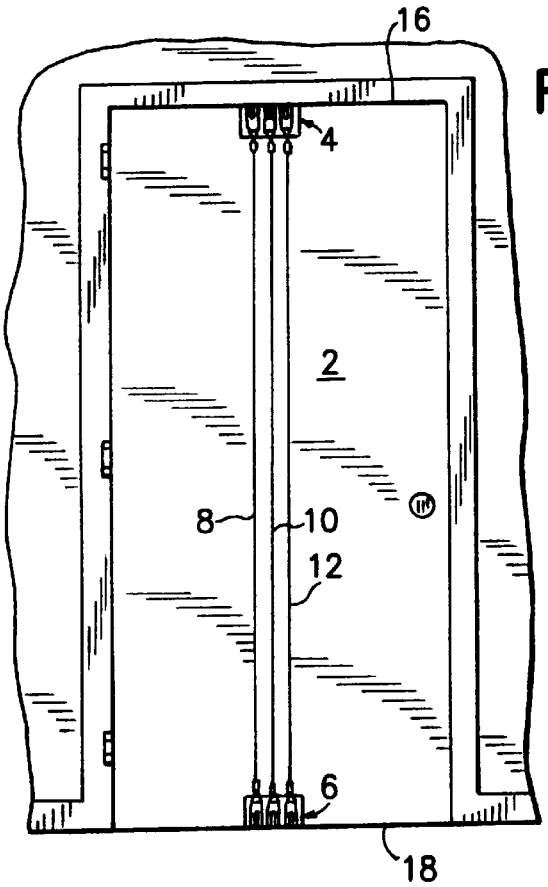
FIG. 1 is a front, elevational view of the invention.
Figure 7:
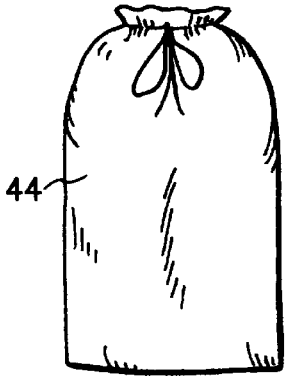
FIG. 7 is a front, elevational view of a bag for holding the invention.

In its simplest embodiment, the invention constitutes a top bracket 4 and a bottom bracket 6 which are mounted respectively on the top edge 16 and the bottom edge 18 of the door 2. A plurality of elastic cords are suspended between the brackets. The top and bottom bracket are of identical construction, and, for the sake of convenience, only one of the brackets will be described.

The top bracket 4 is U-shaped. It includes a rear leg 20 and a front leg 22, which are arranged parallel to each other. Connecting the legs is a base plate 24. Preferably, the top bracket is made as a single, unitary piece.

Preferably, the top bracket is made of a light metal material, such as aluminium. It may, however, be made from any strong and sturdy material, such as composites or plastics. Any material that has sufficient strength to securely hold the cords during exercise may be used.

Defined between the rear leg 20, the front leg 22, and the base 24 is a channel 26, which fits over the top edge 16 of the door 2. Depending on the thickness of the door, will depend the spacing between the legs and the outer surfaces of the door. It is desirable, but not mandatory, that there be as little space as possible, so as to avoid rocking of the bracket during exercise. In some embodiments, it may be desirable to include spacers 34. These may be made of rubber or any other suitable material The spacers are placed between the inner surfaces of the bracket and the outer edges of the door. In this way, the bracket may be held more securely and the rocking can be avoided. Such spacers may preferably be provided in varying thicknesses and included with the kit for the invention.

Figure 2:
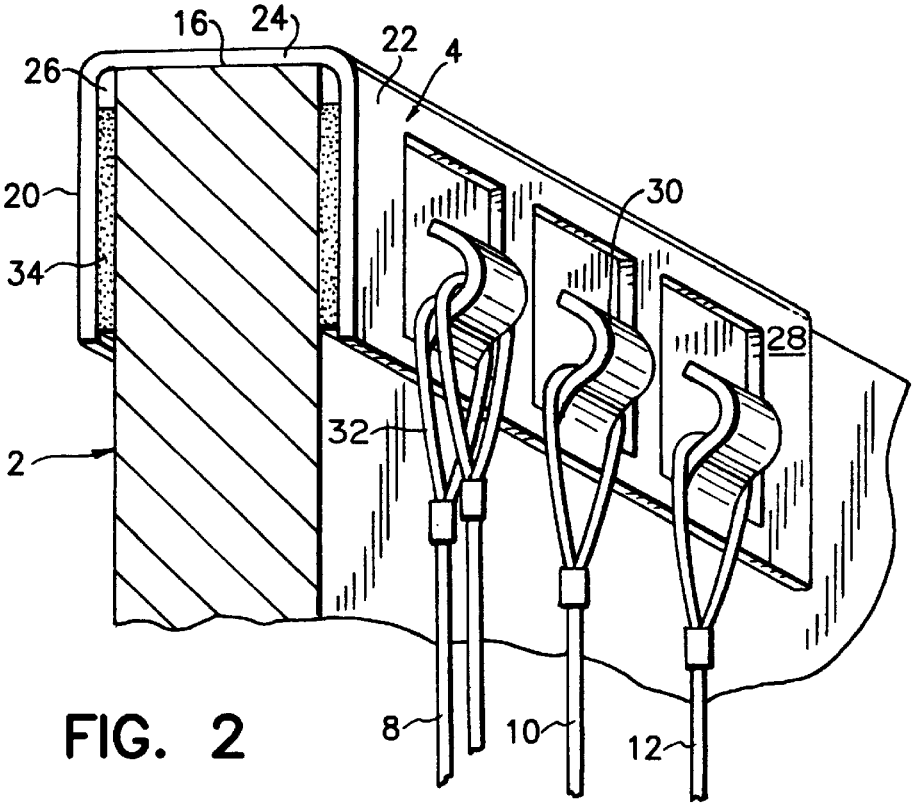
FIG. 2 is an enlarged perspective view, showing a close up of one of the U-shaped brackets and the elastic bands.

On the front surface 28 of the front leg 22 an upwardly extended or rounded hook 30 is provided. It is desirable that the hook be sufficiently long and sufficiently curved, so that the elastic cords may be suspended from it with sufficient security that they do not release during exercise. As shown in FIG. 2, the front surface 28 of the top bracket 4 has three hooks 30. Each hook is of an arcuate shape in order to best hold the elastic bands. In some embodiments, a simple prong or other abutment may be suitable for holding the bands.

As shown in FIG. 2, there are three hooks for holding three separate bands. It is possible for each hook to support one or more bands, as desired. Further, in some embodiments, the top bracket may have only a single hook, two hooks or even more than four hooks. The number of hooks would be dependant on the number of elastic bands that are to be supported by the brackets.

As explained above, the bottom bracket 6 would have a corresponding shape and configuration.

The elastic cords may typically be made of any suitable elastic material. One such material is natural latex rubber. Preferably, each of the elastic cords has a loop 32 or eyelet at each of its ends for securement on the brackets.

In the preferred embodiment, there are three elastic cords 8, 10, and 12 suspended between an aligned pair of top and bottom brackets. A loop 32 at the end of each of the cords is secured on the hook of the respective top and bottom brackets. The cords have different degrees of elasticity, To provide the optimum range of exercise routines, it is desirable that there be two pairs of top and bottom brackets, adjacent to each other, with three elastic cords of different elasticities suspended between each pair of top and bottom brackets. It may be appreciated that as few as two elastic cords may be used, and as many as four or five or more elastic cords may be suspended between an aligned pair of top and bottom brackets.

Figure 4:
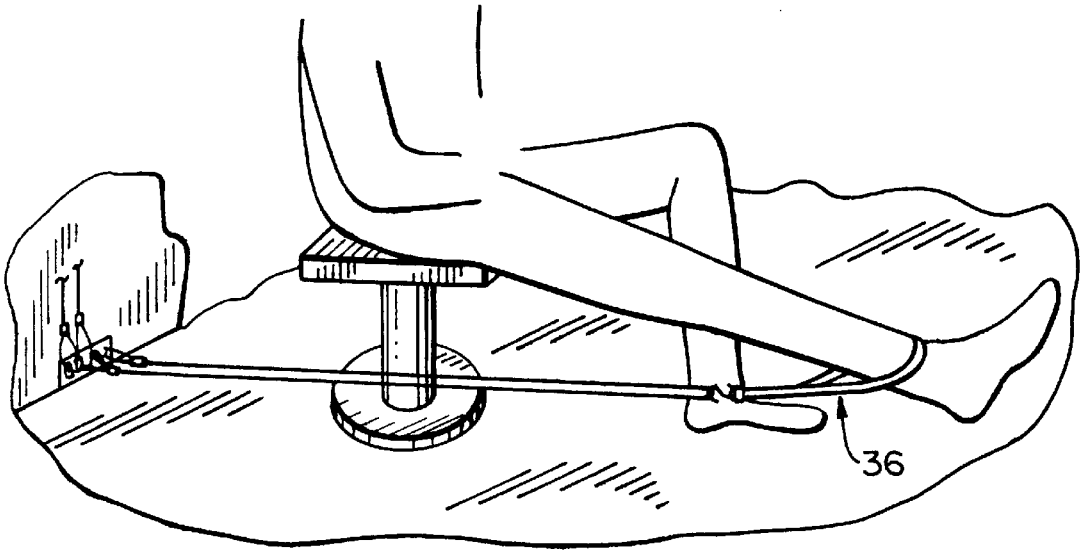
FIG. 4 is a view showing an ankle strap and a person exercising.
Figure 5:
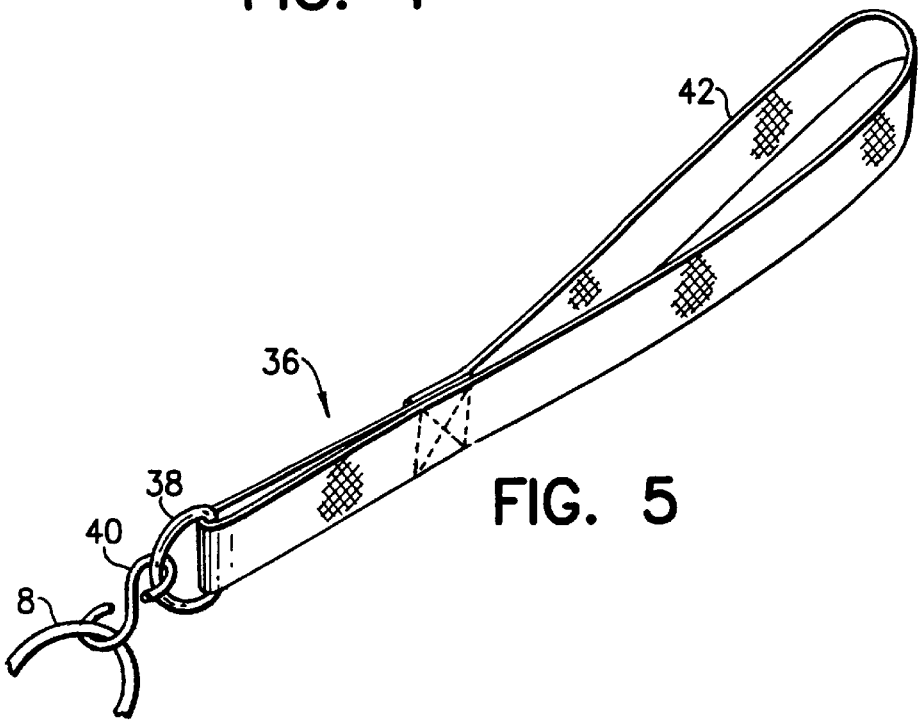
FIG. 5 is a perspective view of the ankle strap.

Also contemplated with the invention is an ankle strap 36, as best shown in FIGS. 4 and 5. The ankle strap may be made of any suitable material. In the preferred embodiment, it is made of woven nylon. One end has a D-ring 38 to which an S-hook 40 is attached. The other end of the S-hook is connected to an appropriate portion of any one of the elastic bands. The other end of the ankle strap defines a loop 42 to facilitate exercising of the lower leg.

The elastic bands or cords may be color coded in order to more easily define their respective elasticities.

In performing an exercise, the exerciser can select for each arm (or leg) any one of the three elastic cords, or any two of the cords, or all three of the cords. This provides seven tension levels that may be used if the cords are of different elasticities. By adding a fourth or fifth cord, an even greater number of tensions and resistances can be achieved.

Depending on where the cord is grasped will depend the particular muscle group of the body that is exercised. Further, by altering the distance from the door, the resistance factor is necessarily changed. For some exercises, both ends of the cord would be connected to the same bracket, either at the top or at the bottom. Thus, the band will essentially be in a U-shape and this provides a whole range of possible exercise routines. In particular, this exercise system will permit isotonic, isometric, concentric, eccentric, plyometric and P.N.F. patterns of exercise. Plyometric exercises are high speed or high velocity exercises, which, for example, are very desirable for exercising the rotator cuff. Such exercises cannot be performed with a pulley exercise system, but work very well with the elastic cords of the instant invention.

Literally dozens of different exercises can be effected with this device to exercise substantially all of the major muscle groups of the body. It may also be used to effectively isolate specific muscle groups, such as the triceps, the biceps and the leg abductor muscles. A full range of motion is also possible with the device. For example, a range of motion from 0° to 90° can be obtained, just like any other desired range of motion.

Figure 3:
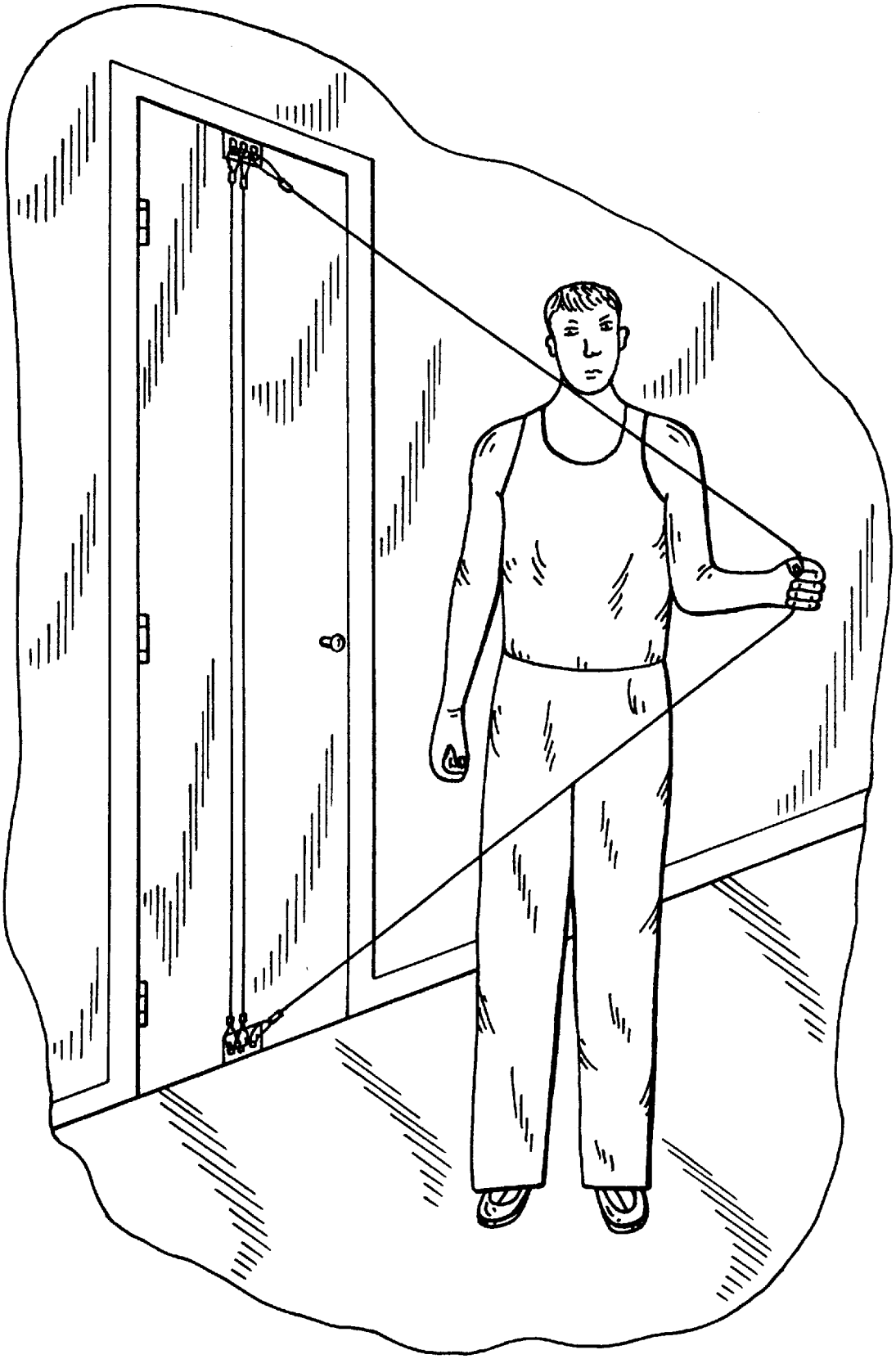
FIG. 3 is a perspective view, showing a person exercising with the device.

In FIG. 3, an exerciser is shown with one particular exercise for strengthening the muscles in the lower forearm In this exercise, the upper arm is straight and parallel to the torso. The arm is bent at the elbow and the forearm is perpendicular to the torso and the upper arm. One of the cords is grabbed in the hand and forearm is moved laterally in order to exercise the external rotator musculature which includes the rotator cuff muscles.

Figure 6:
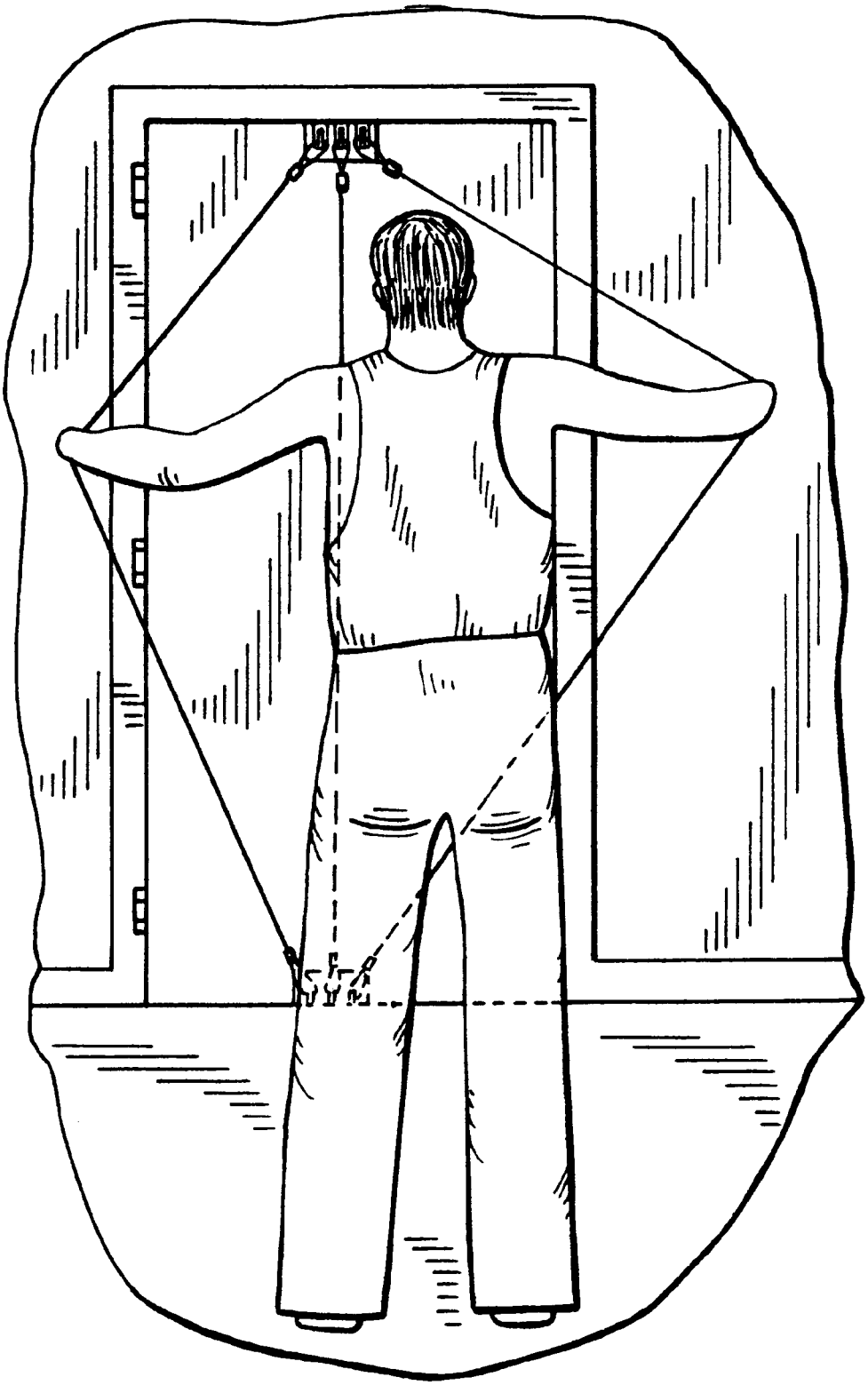
FIG. 6 is a view similar to FIG. 3, but showing a person exercising a different muscle group.

FIG. 6 shows an exercise for strengthening the back muscles. An exerciser stands in front of the device and extends his arms straight forward and perpendicular to the torso. An appropriate elastic cord is grasped in each hand and the arms are moved laterally back and forth in order to exercise the posterior deltoids, rhomboids, trapezius and latissimus dorsi muscles.

A third exercise is shown in FIG. 4. The ankle strap is attached to an appropriate cord and the exerciser sits on a stool or a chair. The loop 42 of the ankle strap is attached to the lower leg. By moving the leg in and out, the quadriceps or leg extensor muscles may be exercised.

As can be appreciated, by grasping the cords at different positions and moving the arms and legs in different directions, almost any muscle group can be exercised.

In many instances, it will be desirable to pack the brackets, spacers and elastic cords in a small nylon sack 44. This will provide easy transportation and storage of the exercise device.

The invention is described in detail with reference to a particular embodiment, but it should be understood that various other modifications can be effected and stir be within the spirit and scope of the invention.

I claim:

1. A portable exercise device comprising:

a pair of U-shaped brackets, each having a plurality of hooks and each bracket adapted for removable mounting on either end of a vertically arranged support surface, whereby the U-shaped cross section of said brackets is of such size so as to tightly engage onto the ends of the vertically arranged support surface to prevent the exercise device from moving during exercise and thereby allowing said hooks of said brackets to be arranged along the upper and lower portions of a front surface of the support surface and along a longitudinal axis of the support surface;

a plurality of elastic cords of respectively different elasticities, each having loop connectors at the distal ends of said cords, said elastic cords suspended between said longitudinally arranged brackets, wherein said loop connectors of said elastic cords are mounted on said hooks of said brackets, thereby allowing each cord to be directly grasped by a user between its distal ends and stretched in any direction ranging away from 0° to 180° from the longitudinal axis of the vertical support surfaces; and an ankle strap having a forward end and a rear end, said forward end of said ankle strap having an attachment means for attaching said ankle strap to the body of an exerciser; and an additional elastic cord secured to said rear end of said ankle strap and attached at its distal ends to a single bracket thereby forming a loop, whereby a user attached to said ankle strap can stretch said additional cord in any direction ranging away from 0° to 180° from the longitudinal axis of the vertical support surface providing resistance for exercising.

2. A portable exercise device according to claim 1 wherein said plurality of elastic cords are mounted on a single hook of each said bracket.

3. A portable exercise device according to claim 1 wherein said plurality of elastic cords are readily removable from said brackets thereby allowing for easy disassembly and portability.

* * * * *